United States Patent [19]

Imazeki et al.

[11] Patent Number: 4,631,377

[45] Date of Patent: Dec. 23, 1986

[54] SLIDE SWITCH WITH INDICATOR LIGHT

[75] Inventors: Kazuyoshi Imazeki; Nobuaki Yokoyama, both of Tokyo, Japan

[73] Assignee: General Research of Electronics, Inc., Tokyo, Japan

[21] Appl. No.: 703,819

[22] Filed: Feb. 21, 1985

[51] Int. Cl.[4] ..... H01H 9/02; H01H 9/16

[52] U.S. Cl. ..... 200/314; 200/16 F; 200/163; 200/254; 200/340; 339/258 R

[58] Field of Search ..... 200/16 R, 16 F, 310–314, 200/162, 163, 254–256, 340, 159 R; 339/258 R, 258 P

[56] References Cited

U.S. PATENT DOCUMENTS

| | | | |
|---|---|---|---|
| 2,922,135 | 1/1960 | Hoberg et al. | 339/258 P |
| 3,805,004 | 4/1974 | Kondo et al. | 200/311 |
| 3,867,596 | 2/1975 | Schadow | 200/314 X |
| 3,927,290 | 12/1975 | Denley | 200/314 |
| 3,969,609 | 7/1976 | Wanner et al. | 200/314 |
| 4,013,855 | 3/1977 | Reichen et al. | 200/314 |
| 4,052,580 | 10/1977 | Stanish | 200/303 X |
| 4,075,442 | 2/1978 | Fukuda et al. | 200/16 F |
| 4,239,950 | 12/1980 | Hinze et al. | 200/254 |

FOREIGN PATENT DOCUMENTS

| | | | |
|---|---|---|---|
| 2108112 | 8/1972 | Fed. Rep. of Germany | 200/314 |

*Primary Examiner*—Stephen Marcus
*Assistant Examiner*—Ernest G. Cusick
*Attorney, Agent, or Firm*—Trexler, Bushnell & Wolters, Ltd.

[57] ABSTRACT

A slide switch comprises a plurality of sets of aligned terminals, each set comprising at least a center terminal and two end terminals, one to either side of the center terminal and aligned along a common axis therewith, and a plurality of elongate slides respectively associated with the sets of terminals. The slides are of sufficient length to engage the center terminal and only one of the associated end terminals. An actuator mounts the slides for movement between a first position wherein the slides electrically couple each of the center terminals with one of its associated end terminals and a second position wherein the slides electrically couple each of the center terminals with the other of its associated end terminals. A light emitting element has a pair of electrodes and is responsive to a given voltage across the electrodes for emitting light. The actuator comprises an actuator body having a recess for mounting the light emitting element therein for observing the presence or absence of light therefrom during operation of the slide switch, and guides for guiding the pair of electrodes into position for electrically conductive contact respectively with the selected ones of the slides.

10 Claims, 10 Drawing Figures

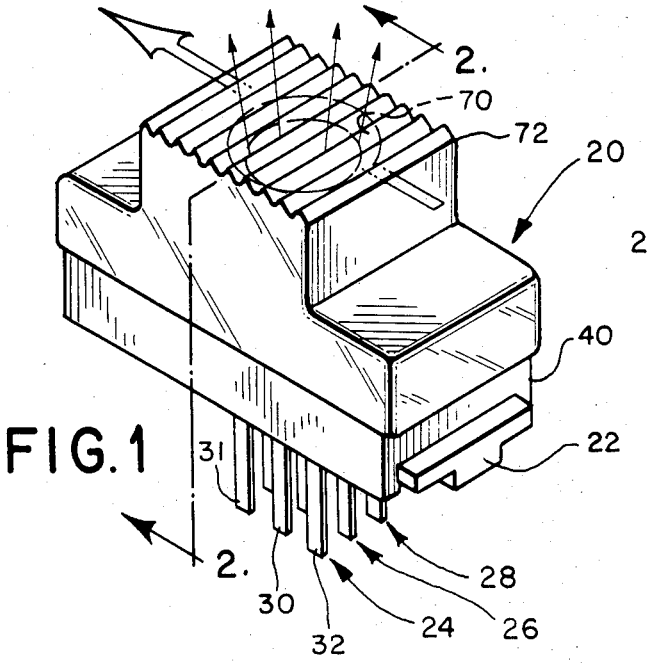
FIG.1
FIG. 2
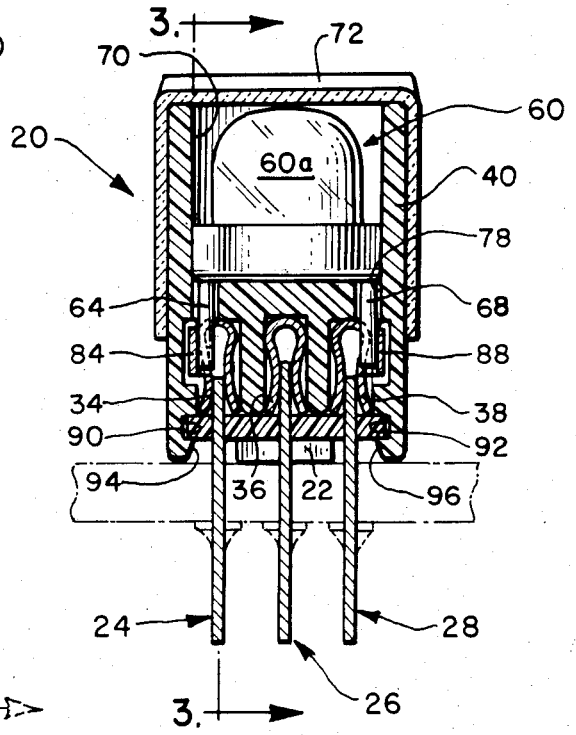
FIG. 3
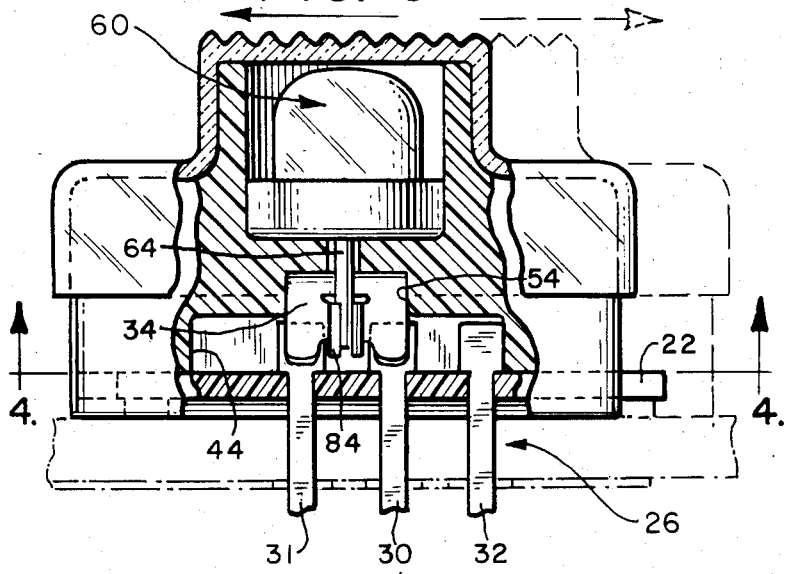
FIG.5
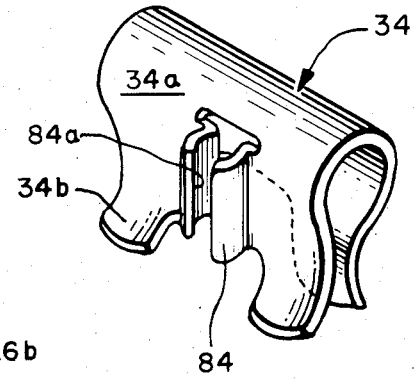
FIG. 4
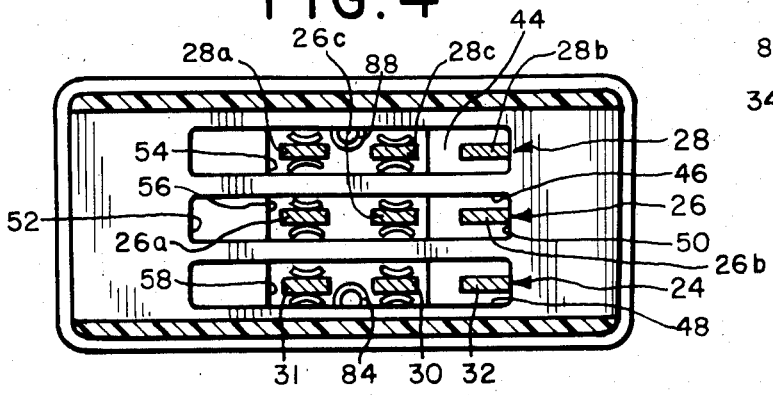

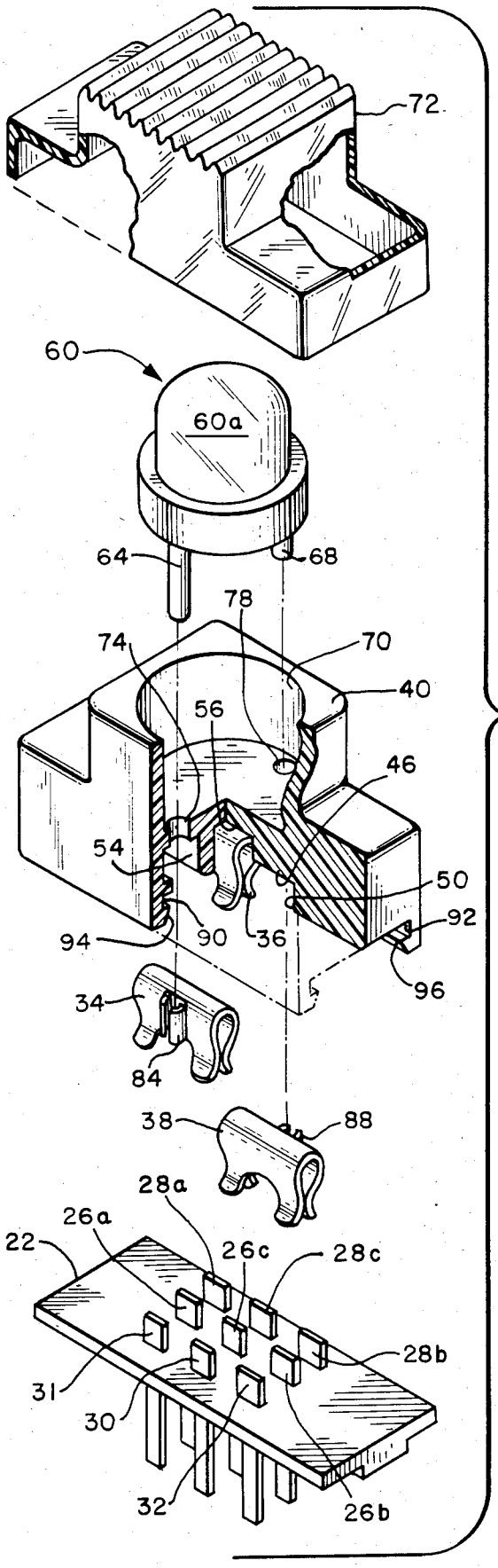
FIG. 6
FIG. 7
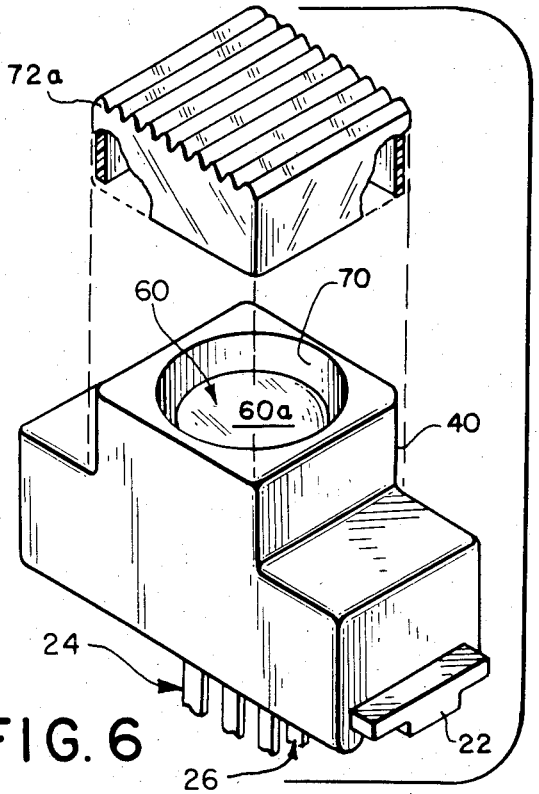
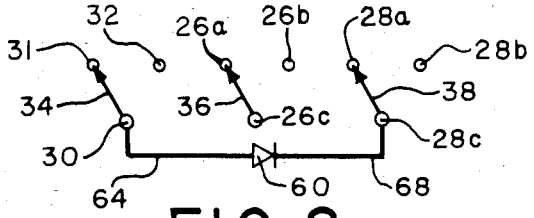
FIG. 8
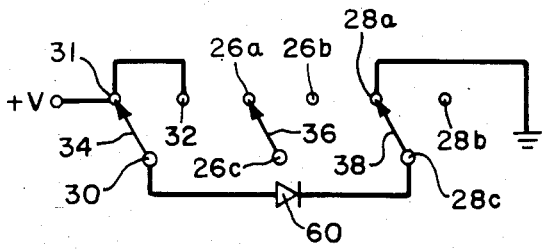
FIG. 9
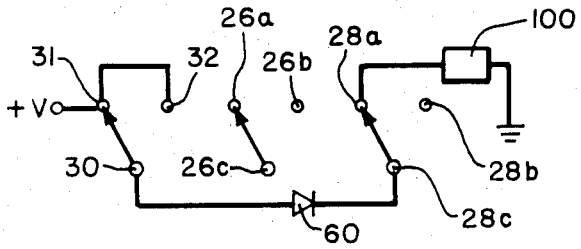
FIG. 10

SLIDE SWITCH WITH INDICATOR LIGHT

BACKGROUND OF THE INVENTION

The invention relates generally to the field of electrical switches and more particularly to a novel slide-type electrical switch including an indicator light adapted to be energized when the switch is in at least one position so as to indicate the condition of the switch.

Many electrical switches include visual indicators to indicate the condition or position of the switch. Some such indicators include light elements mounted to the switch in some fashion and these elements may comprise relatively small lamps or light emitting diodes (LEDs).

In slide switches, one or more selected terminals may be engaged with selected other terminals by action by a sliding contactor or "slide" element which slides in a linear direction over the terminals in response to linear sliding movement of an actuator member. The terminals are arrayed in parallel rows to be simultaneously contacted by a plurality of such slides in response to movement of the actuator member, such as a button or knob. While some arrangements have been proposed heretofore for providing a lamp or LED as an indicator for such a switch, these arrangements have been relatively complicated and expensive, requiring extensive modification of existing slide switches and specialized parts, tooling and the like in their manufacture.

OBJECTS AND SUMMARY OF THE INVENTION

Accordingly, it is a general object of this invention to provide a novel and improved slide switch including an indicator light for indicating the condition or position of the switch.

A more specific object is to provide a slide switch in accordance with the foregoing object which requires but minimal and simple modification of a slide switch to thereby minimize the expense thereof.

A related object is to provide a slide switch in which an indicator light is simply and inexpensively mounted in the switch actuator with but minimal modification to the switch, resulting in an indicator which is relatively inexpensive and yet highly reliable in operation.

Briefly, and in accordance with the foregoing objects, a slide switch in accordance with the invention comprises a plurality of sets of aligned terminals, each said set comprising at least a center terminal and two end terminals, one to either side of said center terminal and aligned along a common axis therewith; a plurality of elongate slide means respectively associated with said first and second sets of terminals, said slide means being of sufficient length to engage said center terminal and only one of the associated end terminals; actuator means including means for mounting said slide means for movement in unison with said actuator means between a first position wherein said slide means electrically couple each of said center terminals with one of its associated end terminals and a second position wherein said slide means electrically couple each of said center terminals with the other of its associated end terminals; light emitting means having a pair of electrodes and responsive to a given voltage across said electrodes for emitting light; said actuator means further including an actuator body having recess means for mounting said light emitting means for observing the presence or absence of light therefrom during operation of said slide switch, and guide means for guiding said pair of electrodes into position for electricaly conductive contact with selected ones of said slide means.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawing, in which like reference numerals identify like elements, and in which:

FIG. 1 is a perspective view of an assembled slide switch in accordance with the present invention;

FIG. 2 is an enlarged sectional view taken generally along the line 2—2 of FIG. 1;

FIG. 3 is a side elevation, partially broken away and partially in section, taken in the plane of the line 3—3 of FIG. 2;

FIG. 4 is a sectional view taken generally along the line 4—4 of FIG. 3;

FIG. 5 is an enlarged perspective view of a slide-type contact member of the switch of the invention;

FIG. 6 is an exploded perspective view of the switch of FIG. 1;

FIG. 7 is an exploded perspective view illustrating an alternative form of a switch body and translucent cap for the switch of FIG. 1;

FIG. 8 is a schematic circuit diagram illustrating the circuit connections of the assembled switch of FIG. 1;

FIG. 9 is a schematic circuit diagram illustrating one possible utilization circuit for the switch of FIG. 1; and FIG. 10 is a schematic circuit diagram illustrating a further possible utilization circuit for the switch of FIG. 1.

DETAILED DESCRIPTION OF THE ILLUSTRATED EMBODIMENT

Referring now to the drawings, and initially to FIGS. 1 through 6, a slide switch in accordance with the invention is designated generally by the reference numeral 20. The slide switch 20 generally comprises a substantially flat base plate 22 which mounts thereon a plurality of sets of terminals, here shown as three sets of terminals 24, 26 and 28. A lesser or greater number of sets of terminals may be provided without departing from the invention.

In the illustrated embodiment, these sets of terminals are aligned in generally parallel rows and columns, and are substantially identical sets, whereby only the row or set of terminals 24 will be described in detail. The set of terminals 24 includes at least a center terminal 30 and two end terminals 31, 32, one to either side of the center terminal and aligned along a common axis therewith to form the row or set of terminals 24. Preferably, similar center terminals **26*c*, 28*c* and end terminals 26*a*, 26*b*, 28*a*, 28*b* of the other sets 26 and 28 are aligned with respective terminals 30, 31, and 32 to form aligned or parallel columns in the row-and-column arrangement. However, it should be appreciated that fewer or more such terminals in each set or row 24, 26 and 28** may be utilized without departing from the invention. Moreover, the individual rows may be offset somewhat such that respective terminals thereof do not align to form columns as illustrated without departing from the invention.

A plurality of elongate slides or slide means, which in the illustrated embodiment comprise three generally U-shaped slides or slide-type contactor elements 34, 36 and 38, are associated respectively with the sets of terminals 24, 26 and 28. That is, one such slide is provided for each set of terminals, which may comprise fewer or more than the three sets illustrated without departing from the invention. In accordance with the invention, each of these slides or slide means 34, 36 and 38 is of sufficient length to engage its associated center terminal, for example, terminal 30 and only one of the associated end terminals, for example, terminals 31, 32 (see FIG. 3).

The terminals 24, 26 and 28 comprise generally flat, rectilinear upstanding members. Acordingly, the generally U-shaped slide means or contactors 34, 36 and 38 are of a complementary cross-section for slideable or wiping engagement over protruding end portions, of these terminals which protrude upwardly from the generally flat base plate 22.

An actuator or actuator means comprises an actuator body 40 which has formed therein a plurality of elongate, parallel slots or recesses 44, 46 and 48, each for mounting one of the slides 34, 36 and 38 therein for movement in unison with the actuator means or actuator body 40. This movement is between a first position, for example as illustrated in FIG. 3, wherein the slide means electrically couple each of the center terminals with one of the associated end terminals and a second position (not shown) wherein the slide means electrically couple each of the center terminals with the other of its associated end terminals. In the illustrated embodiment, each of the elongate slots 44, 46 and 48 includes a raised central portion, 54, 56 and 58 of substantially similar dimensions to body portions (e.g. 34*a*) the respective slides 34, 36 and 38 for receiving these slides 34, 36 and 38 therein. A remaining portion of each of the slots 44, 46 and 48 is of greater length and gripping leg portions (e.g. 34*b*) of each slide extend into these portions to engage the terminals. At least one of these slots defines opposing end stop or abutment surfaces, for example end surfaces 50 and 52 of slot 46, for defining limits of the slideable movement of the actuator body 40 corresponding to the above-described first and second positions thereof respectively. In the illustrated embodiment, abutment surfaces such as the surfaces 50 and 52 are defined on all three of the slots 44, 46 and 48. These surfaces engage respective outer facing edges of the end terminals, such as terminals 31 and 32, for defining limits of movement of the actuator body 40 relative to the terminals.

A light emitting means or element, may comprise a light bulb or lamp, but preferably comprises a light emitting diode (LED) 60 is provided as an indicator, that is, to give an indication of the relative position of the slide switch 20. This light emitting element or LED 60 has a pair of electrodes or elongate leads 64, 68 and is responsive to a given or predetermined voltage across these electrodes for emitting light. The actuator body 40 includes a recess 70 for mounting the light emitting means or LED 60 therein. In this regard, light emitting means 60 will be seen to also comprise a body 60*a*, the recess 70 being of complementary configuration for receiving substantially the entire body 60*a* therewithin, in the illustrated embodiment.

Preferably, recess 70 has an open upper surface so that the presence or absence of light from the light emitting element or LED may be observed during operation of the slide switch. In the embodiment illustrated, an additional translucent cover or cap member 72 is interposed over the recess 70 to prevent the ingress of dirt, dust or the like to the recess 70 and other parts of the slide switch.

In accordance with a further feature of the invention, guide means in the form of a pair of through apertures or channels 74, 78 are provided for guiding the electrodes or leads 64, 68 into position for electrically conductive contact with selected ones of the slide means or slide-type contactor elements 34, 36, and 38. In the illustrated embodiment, these guide channels or apertures comprise through apertures intermediate the recess 70 and the respective slots or recess portion 54 and 58. Hence the leads or electrodes 64 and 68 are guided into a position for electrical engagement with the slides 34 and 38.

Further to this end, each of these slides 34 and 38 includes thereon a generally tubular socket means or member 84, 88 for engaging electrodes 64 and 68, respectively. In the illustrated embodiment, each of the tubular socket means or members 84, 88, as best viewed in FIG. 5, comprises a generally tubular socket of similar inner diameter to the outer diameter or respective electrodes 64 and 68. Preferably, each socket further comprises a generally resilient or spring-like body having an open surface or gap 84*a* therein for further adjustment of the inner diameter thereof, to assure secure engagement, as by a press fit with the associated electrodes 64 or 68. These tubular socket means or members 84, 88 are coupled with external slide surfaces of the U-shaped slide members 34, 38 and in electrically conductive contact therewith.

It will be further noted that the channels or guide apertures 74 and 78 guide each of the electrodes or leads 64, 68 in a substantially straight path or line to its associated slide member, substantially without any bending of the electrode. This permits relative simple and rapid assembly of the LED with the actuator body 40 in accordance with the invention. Referring briefly to FIG. 7 in accordance with an alternative form of the invention, the cover or cap member 72, here designated 72*a*, may alternatively cover only the portion of actuator body or housing 40 in which the recess 70 for receiving LED or light emitting means 60 is formed.

The body 40 includes a pair of inwardly facing grooves 90 and 92, which slideably engage oppositely outwardly facing edge portions of the flat base plate 22, to facilitate the assembly of the slide switch of the invention. In this regard, suitable cammed or ramp-like lead-in surfaces 94 and 96 may be provided to facilitate snapping engagement of the grooves 90 and 92 over the opposing edges of the base plate 22.

It is contemplated that assembly of the slide switch of the invention would proceed initially inserting the slides or contactors into the respective recess portions 54, 56 and 58. Preferably, body portions 34*a* of the slides (and sockets 84, 88 of slides 34 and 38) are held in these recesses 54, 56, 58 substantially in a press fit, while gripping leg portions 34*b* thereof extend outwardly of the recesses to engage the associated terminals. Thereafter, the LED may be introduced into recess 70 and the leads 64 and 68 thereof fed through respective guide apertures 74 and 78 into engagement with sockets 84 and 88 provided therefor. Thereupon, the translucent cover 72 or 72*a* may be affixed to the actuator body. The actuator body may then be snappingly engaged for slideable movement with base plate 22 as just described, aligning the open faces of the U-shaped contactors or slide elements with their respective sets or rows of terminals 24, 26 and 28 during this latter process.

Referring briefly to FIGS. 8, 9 and 10, circuit configurations of the slide switch of FIGS. 1 through 7 are illustrated. In FIG. 8, the basic switch circuit obtained by the construction of slides just described is illustrated. The LED 60 is coupled by its leads or electrodes 64 and 68 intermediate respective center terminals 30 and 28*c* of the sets of terminals 24 and 28. In this regard, the respective center terminals of terminals rows or sets 26 and 28 are indicated in FIGS. 8 through 10 as 26*c* and 28*c*, respectively. Similarly respective end terminals of these sets 26 and 28 are designated 26*a*, 26*b*, and 28*a*, 28*b*, respectively. Slide member 34 is represented as a contactor coupled to center terminal 30 and moveable between end terminal 31 and 32. The additional slides 36 and 38 are similarly represented with respect to their sets of terminals 26 and 28.

Referring to FIG. 9, an exemplary utilization circuit includes coupling respective end terminals 31 and 32 together to a source of positive potential (+V), and one of the end terminals 28*a* or 28*b* to circuit ground. Accordingly, when the switch is actuated to a position wherein the slides make contact between their respective center terminals and the end terminals 31, 26*a* and 28*a*, the LED 60 will be energized; however, when the switch is in the opposite position, with the slides or contactors contacting the opposite terminals 32, 26*b*, 28*b*, the LED 60 will not be energized or lighted.

Referring briefly to FIG. 10, a similar circuit configuration to FIG. 9 is illustrated with the addition of a load element 100. This load 100 may be interposed in the ground circuit from teminal 28*a*, while maintaining operation of the LED in the same fashion as described above for the circuit of FIG. 9. The load 100 may comprise any circuit element which is intended to be energized from the same source of potential +V when the switch is actuated to the position illustrated in FIG. 10.

The set of terminals 26 may be connected to any desired external circuit elements without affecting the foregoing arrangement for lighting LED 60 in response only to movement of the slide switch to the illustrated position. It will be noted that the position illustrated in schematic form in FIGS. 8, 9 and 10 corresponds to the position of the slide switch illustrated in FIGS. 1 through 4. It will be recognized that any desired additional number of sets of terminals, such as the set 26, which have no circuit connection to the circuit of LED 60 may be added for accommodating any number of desired additional external circuits, without departing from the invention. Moreover, in the arrangement of FIGS. 9 and 10 the ground circuit may be coupled to terminal 28*b*, rather than terminal 28*a* whereupon the LED will not be energized and will remain unlighted with the switch in the position illustrated in FIGS. 1 though 4, but will be energized and lighted in the opposite position. Circuit configurations other than those shown in FIGS. 9 and 10 may of course be utilized without departing from the invention.

While particular embodiments of the invention have been shown and described in detail, it will be obvious to those skilled in the art that changes and modifications of the present invention may be made without departing from the invention in its broader aspects, some of which changes and modifications being matters of routine engineering or design, and others being apparent only after study. As such, the scope of the invention should not be limited by the particular embodiments and specific constructions described herein but should be defined by the appended claims and equivalents thereof. Accordingly, the aim in the appended claims is to cover all such changes and modifications as fall within the true spirit and scope of the invention.

The invention is claimed as follows:

1. A slide switch comprising: a plurality of sets of aligned terminals, each said set comprising at least a center terminal and two end terminals, one to either side of said center terminal and aligned along a common axis therewith; a plurality of elongate slide means for slidably engaging predetermined ones of said terminals and respectively associated with said plurality of sets of terminals, said slide means being of sufficient length to engage said center terminal and only one of the associated end terminals; actuator means including means for mounting said slide means for movement in unison with said actuator means between a first position wherein said slide means electrically couple each of said center terminals with one of its associated end terminals and a second position wherein said slide means electrically couple each of said center terminals with ther other of its associated end terminals; light emitting means having a pair of electrodes and responsive to a given voltage across said electrodes for emitting light; said actuator means further including an actuator body having a recess for mounting said light emitting means therein for observing the presence or absence of light therefrom during operation of said slide switch; and guide means for guiding said pair of electrodes into position for electrically conductive contact with selected ones of said plurality of slide means; wherein said terminals comprise generally flat, rectilinear upstanding members, wherein said slide means comprise elongate members which are generally U-shaped in cross-section for complementary slideable, wiping engagement over protruding end portions of said terminals, and further including tubular socket members located on external side surfaces of ones of said elongate U-shaped members comprising said selected ones of said plurality of slide means for egaging said electrodes.

2. A slide switch according to claim 1 and further including a substantially flat, rectangular base plate for mounting said sets of terminals.

3. A slide switch according to claim 2, wherein said actuator body includes a pair of inwardly facing elongate channels for slideably engaging oppositely laterally outwardly facing edges of said base plate.

4. A slide switch according to claim 3 wherein said channels are provided with camp-like lead-in surfaces to facilitate engagement thereof with said base plate edges.

5. A slide switch according to claim 1, wherein said mounting means comprise a plurality of parallel elongate mounting slots formed in said actuator body, each for mounting one of said slide means therein.

6. A slide switch according to claim 5 wherein said light emitting means comprises a body; wherein said pair of electrodes comprise elongate leads depending from said body in spaced parallel condition; and wherein said guide means comprises a pair of substantially straight and parallel through apertures extending from said recess to ones of said mounting slots which mount said selected ones of said slide means for guiding each of said elongate leads in a substantially straight path to one of said selected ones of said slide means substantially without bending of said electrodes.

7. A slide switch according to claim 5 wherein at least one of said elongate slots further includes stop surfaces at opposite ends thereof for defining limits of slideable movement of said actuator corresponding to said first position and said second position respectively.

8. A slide switch according to claim 1 wherein said light emitting means comprises a light bulb.

9. A slide switch according to claim 1 wherein said light emitting means comprises a light emitting diode.

10. A slide switch according to claim 1 and further including a translucent cap overlying said recess and the light emitting means therein.

* * * * *